US007352986B2

(12) United States Patent
Mikita et al.

(10) Patent No.: US 7,352,986 B2
(45) Date of Patent: Apr. 1, 2008

(54) FIXING DEVICE AND IMAGE FORMING APPARATUS HAVING THE SAME

(75) Inventors: Toshiya Mikita, Yao (JP); Yasunori Minakuchi, Nara (JP); Yoshinobu Tateishi, Nara (JP); Hiroaki Hori, Kyoto (JP); Atsushi Ide, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 236 days.

(21) Appl. No.: 11/333,205

(22) Filed: Jan. 18, 2006

(65) Prior Publication Data

US 2006/0159496 A1 Jul. 20, 2006

(30) Foreign Application Priority Data

Jan. 19, 2005 (JP) ..... P2005-011802

(51) Int. Cl.
*G03G 15/20* (2006.01)

(52) U.S. Cl. ..... 399/327

(58) Field of Classification Search ..... 399/324–327
See application file for complete search history.

(56) References Cited

U.S. PATENT DOCUMENTS 5,893,663 A * 4/1999 Facci et al. ..... 399/168
2006/0072945 A1* 4/2006 Ide ..... 399/327

FOREIGN PATENT DOCUMENTS

| | | | |
|---|---|---|---|
| JP | 07-261591 | | 10/1995 |
| JP | 09096988 A | * | 4/1997 |
| JP | 11-038815 | | 2/1999 |
| JP | 2001-005327 | | 1/2001 |
| JP | 2001-100583 | | 4/2001 |
| JP | 2002-278347 | | 9/2002 |
| JP | 2003-107952 | | 4/2003 |

* cited by examiner

*Primary Examiner*—David M. Gray
*Assistant Examiner*—Ryan Gleitz
(74) *Attorney, Agent, or Firm*—Nixon & Vanderhye, P.C.

(57) ABSTRACT

A fixing device includes a feeding roller for feeding a belt-shaped cleaning member which has been rolled up, and a winding roller for taking up the cleaning member which has been fed from the feeding roller and cleaned a surface of the fixing roller, the winding roller being provided so as to pressure-contact the feeding roller. The winding roller is rotated by a time control due to a control portion so that a sum of a feed amount of the cleaning member which is fed by the feeding roller at one feeding occasion, and a take-up amount of the cleaning member which is taken up by the winding roller at one take-up occasion, is equal to or more than a double of a length Ln of a nip section.

5 Claims, 12 Drawing Sheets

FIG. 5

| | | ROTATIONAL ANGLE OF WINDING ROLLER (° ) | LENGTH OF DRIVING TIME OF WINDING ROLLER (sec.) | TAKEN-UP LENGTH OF CLEANING MEMBER (mm) | ROTATIONAL ANGLE OF FEEDING ROLLER (° ) | FED LENGTH OF CLEANING MEMBER (mm) |
|---|---|---|---|---|---|---|
| $n_1$ | INITIAL STATE (IMMEDIATE AFTERMATH OF REPLACEMENT OF CLEANING MEMBER) | 200 | 3.33 | 10.5 | 60 | 10.5 |
| $n_m$ | MIDCOURCE OF LIFE SPAN (WINDING/FEEDING ROLLER DIAMETERS :BOTH 13$\phi$mm) | 93 | 1.55 | 10.5 | 93 | 10.5 |
| $n_e$ | ENDING LIFE SPAN (IMMEDIATE BEFOREMATH OF REPLACEMENT OF CLEANING MEMBER) | 60 | 1.0 | 10.5 | 200 | 10.5 |

FIG. 7

| TYPES OF SHEET | PRINT RATIO | ROTATION CYCLE OF WINDING ROLLER (ONE TIME/NUMBR OF PRINTING SHEETS) | CONVERSION RATE TO A4 WIDTHWISE |
|---|---|---|---|
| A3 | 5% OR LESS | 10 SHEETS | ×2.00 |
| | 5 TO 8% | 7 SHEETS | |
| | 8 TO 12% | 5 SHEETS | |
| | 12% OR MORE | 3 SHEETS | |
| B4 | 5% OR LESS | 10 SHEETS | ×2.00 |
| | 5 TO 8% | 7 SHEETS | |
| | 8 TO 12% | 5 SHEETS | |
| | 12% OR MORE | 3 SHEETS | |
| A4 LENGTHWISE CONVEYANCE | 5% OR LESS | 15 SHEETS | ×1.33 |
| | 5 TO 8% | 10 SHEETS | |
| | 8 TO 12% | 7 SHEETS | |
| | 12% OR MORE | 5 SHEETS | |
| A4 WIDTHWISE CONVEYANCE | 5% OR LESS | 20 SHEETS | ×1.00 |
| | 5 TO 8% | 15 SHEETS | |
| | 8 TO 12% | 10 SHEETS | |
| | 12% OR MORE | 6 SHEETS | |
| B5/SMALL SIZE SHEET SUCH AS POSTCARD | 5% OR LESS | 30 SHEETS | ×0.67 |
| | 5 TO 8% | 20 SHEETS | |
| | 8 TO 12% | 15 SHEETS | |
| | 12% OR MORE | 10 SHEETS | |

FIG. 8

| TYPES OF SHEET | PRINT RATIO | ROTATION CYCLE OF WINDING ROLLER (ONE TIME/NUMBR OF PRINTING SHEETS) | CONVERSION RATE TO A4 WIDTHWISE AND PRINT RATIO OF 5% OR LESS |
|---|---|---|---|
| A4 WIDTHWISE CONVEYANCE | 5% OR LESS | 20 SHEETS | ×1.00 |
| | 5 TO 8% | 15 SHEETS | ×1.33 |
| | 8 TO 12% | 10 SHEETS | ×2.00 |
| | 12% OR MORE | 6 SHEETS | ×3.33 |

FIXING DEVICE AND IMAGE FORMING APPARATUS HAVING THE SAME

BACKGROUND OF THE INVENTION

1. Field of the Invention

The present invention relates to a fixing device favorably for use in an electrophotographic image forming apparatus, and to an image forming apparatus having the same.

2. Description of the Related Art

In an image formation using an electrophotographic system, a photoreceptor charged with a uniform electric potential is exposed to light in accordance with image information so that an electrostatic latent image is formed. The formed electrostatic latent image is developed by a developer so as to be visualized. The visualized image is transferred on a recording paper or the like, and the transferred developer on the recording paper is made to be fixed so as to form a solid recording image.

The fixing device used for such image formation, is generally composed of a heating roller and a pressure roller. The fixing device has such a configuration that, in passing the recording paper on which the developer for forming a visualized image through a pressure contact region (hereinafter referred to as a nip section) of the heating roller and the pressure roller, which pressure contact region is formed by pressing the pressure roller against the heating roller, unfixed developer is fused and fixed by heating of the heating roller and pressing of the pressure roller.

During a fixing operation in the fixing device, there sometimes occurs a so-called hot offset that the developer fused on the nip section of the both rollers is not all fixed on the recording paper, but a part of the developer is attached to a surface of the roller. For instance, the developer attached to the heating roller is transferred on a portion which should be properly a white base, on a recording paper on which the developer is to be subsequently fixed, with the result that an image defect is made to occur.

Moreover, on the pressure roller, the developer which has already fixed to a back surface of the conveyed recording paper, for instance as in a case of duplex print, is sometimes fused again by heat in passing through the nip section and a part of the developer is transferred and attached to the pressure roller. The developer thus attached to the pressure roller may cause the image defect and further, may cause a soil of the back surface of the recording paper.

The image defect caused by the hot offset in the fixing device sometimes remains, in a case of black-and-white print, mere defects such as a fog in a white base of the formed image, a soil on the back surface of the recording paper, or the like in a tolerable range. However, in a case of full-color print, since a developer having a color different from a prescribed one is transferred from the both rollers, there often occur practically intolerable defects.

As a related art for solving such a problem, there is an apparatus having roller cleaning units on the both rollers provided in a fixing device (refer to Japanese Unexamined Patent Publication JP-A 2003-107952).

FIG. 10 is a schematic view showing a configuration of a roller cleaning unit 1 provided in a related art fixing device. FIG. 10 illustrates the roller cleaning unit 1 provided on a heating roller 2 in the fixing device.

The roller cleaning unit 1 comprises a feeding roller 4 for feeding a belt-shaped cleaning member 3 which has been previously rolled up, a winding roller 5 for taking up the cleaning member 3 fed from the feeding roller 4, and a pressure-contact roller 6 (also referred to as a web pressure-contact roller) provided between the feeding roller 4 and the winding roller 5 so as to press the cleaning member 3 on the heating roller 2.

The roller cleaning unit 1 presses the cleaning member 3 on the heating roller 2 which is rotated in an arrow sign 7 direction in a state where the winding roller 5, the feeding roller 4, and the pressure-contact roller 6 are made to be at rest without being rotated so that the heating roller 2 and the cleaning member 3 are made to be slidingly scrubbed with each other. By so doing, a developer 8*a* attached in a fused state to an outer circumferential surface of the heating roller 2 is removed and the removed developer 8*b* is accumulated, still in a substantially fused state, in a gap formed by the cleaning member 3 located between the pressure-contact roller 6 and the winding roller 5, and the surface of the heating roller 2.

When the developer 8*b* accumulated in the gap is excessively built up, cleaning capability is decreased. Accordingly, when the accumulating developer 8*b* reaches a certain amount level, the roller cleaning unit 1 rotates the feeding roller 4 in an arrow sign 10 direction so as to feed the cleaning member 3, and the winding roller 6 in an arrow sign 11 direction, and further operates the winding roller 5 for take-up in an arrow sign 9 direction so as to take up the cleaning member 3, with the result that the developer 8*b* is made to be detached from the surface of the heating roller 2 in a state where the developer 8*b* is attached to the cleaning member 3.

When a feed amount of the cleaning member 3 due to this feeding roller 4 is small, a portion on the cleaning member 3 which has been once used for cleaning cannot be fully replaced by a clean portion on the cleaning member 3. Accordingly, the cleaning capability cannot be sufficiently recovered despite feeding of the cleaning member 3. Further, when the feed amount of the cleaning member 3 is too large, the clean cleaning member 3 will be unnecessarily consumed, so that running cost will be increased.

Furthermore, when a take-up amount due to the winding roller 5 is smaller than the feed amount of the cleaning member 3 due to the feeding roller 4, the fed cleaning member 3 sags between the feeding roller 4 and the winding roller 5 so that sufficient cleaning capability cannot be achieved. On the other hand, the take-up amount due to the winding roller 5 is larger than the feed amount of the cleaning member 3 due to the feeding roller 4, excessive tension is loaded on the cleaning member 3 and ultimately, the cleaning member 3 may be torn apart.

As described above, it is extremely important in the roller cleaning unit 1 to control the feed amount and take-up amount of the cleaning member 3. However, these points are not disclosed or suggested at all in the Japanese Unexamined Patent Publication JP-A 2003-107952.

In view of this problem, the applicant of the invention proposes to control each rotary operation of the feeding roller and winding roller in the fixing device so that a sum of a feed amount of the cleaning member which is fed by the feeding roller at one feeding occasion, and a take-up amount of the cleaning member which is taken up by the winding roller at one take-up occasion, is equal to or more than a double of a length of a nip section of a pressure-contact roller.

FIGS. 11A and 11B are schematic views each showing a fixing roller cleaning unit 20 provided in the fixing device in connection with the proposed art. FIG. 11A shows the fixing roller cleaning unit 20 in an initial state that a cleaning member 23 fully rolled up by a feeding roller 21 starts to be fed. FIG. 11B shows the fixing roller cleaning unit 20 in a state that almost all the cleaning member 23 previously rolled up by the feeding roller 21 has been fed, and taken up by a winding roller 22.

In the fixing roller cleaning unit 20 each shown in FIGS. 11A and 11B, the cleaning member 23 is fed from the feeding roller 21, and taken up by the winding roller 22 through a nip section 26 between a pressure-contact roller 25 disposed so as to contact a heating roller 24, and the heating roller 24 of fixing rollers. By so doing, a developer on a surface of the heating roller 24 is cleaned away.

In this fixing roller cleaning unit 20, when the surface of the heating roller 24 is cleaned, a control portion (not shown) provided in the fixing device controls each rotational angle of the feeding roller 21 and the winding roller 22 by adjusting a rotational time thereof so that a sum of a feed amount of the cleaning member 23 which is fed by the feeding roller 21 at one feeding occasion, and a take-up amount of the cleaning member 23 which is taken up by the winding roller 22 at one take-up occasion, is equal to or more than a double of a length of the nip section 26 in a circumferential direction of the pressure-contact roller 25.

Accordingly, in the fixing roller cleaning unit 20, both of the feeding roller 21 and the winding roller 22 need driving systems and control systems for controlling the rotational angle, that is to say, the rotational time. Moreover, in order to stop the rollers at exact rotary portions after the rollers rotate for a predetermined time, the feeding roller 21 is provided with a feeding roller brake 27 while the winding roller 22 is provided with a winding roller brake 28. Consequently, the apparatus has a complex configuration, and a setting space for the apparatus becomes large. This problem should be solved to improve the apparatus.

SUMMARY OF THE INVENTION

An object of the invention is to provide a fixing device being capable of realizing space-saving with a simple configuration thereof, and controlling feed amount and take-up amount of a belt-shaped cleaning member to favorable amounts when the cleaning member performs cleaning in pressure contact with a fixing roller (a heating roller or a pressure roller), and to provide an image forming apparatus having the fixing device.

The invention provides a fixing device comprising:

fixing rollers which form a pair of rotators, for fusing and fixing an unfixed developer onto a recording medium by passing the recording medium having an image of an unfixed developer formed thereon through a pressure contact section formed by the fixing rollers;

a belt-shaped cleaning member provided so as to contact at least either one of the fixing rollers, for cleaning a surface of the fixing roller;

a pressure-contact roller provided so that a nip section serving as a press portion is formed by pressing the cleaning member onto the fixing roller which is in contact with the cleaning member;

a feeding roller for feeding the belt-shaped cleaning member which has been rolled up;

a winding roller for taking up the cleaning member which has been fed from the feeding roller and cleaned the surface of the fixing roller, the winding roller being provided so as to have a surface layer thereof in contact or pressure-contact with a surface layer of the feeding roller via the cleaning member; and a control portion for controlling rotary operation of either the feeding roller or the winding roller so that a sum of a feed amount of the cleaning member which is fed by the feeding roller at one feeding occasion, and a take-up amount of the cleaning member which is taken up by the winding roller at one take-up occasion, is equal to or more than a double of a length of the nip section in a circumferential direction of the pressure-contact roller.

According to the invention, a winding roller and a feeding roller provided in the image forming apparatus are provided so as to have surface layers thereof in contact or pressure-contact with each other via a cleaning member. A control portion controls rotary operation of either the feeding roller or the winding roller so that a sum of a feed amount of the cleaning member which is fed by the feeding roller at one feeding occasion, and a take-up amount of the cleaning member which is taken up by the winding roller at one take-up occasion, is equal to or more than a double of a length of a nip section in a circumferential direction of a pressure-contact roller.

Due to the foregoing, the cleaning member having a longer length than the nip section is fed and taken up at every one feeding/take-up occasion. Accordingly, a sufficient length of the clean cleaning member is supplied to the nip section so that the cleaning capability can be reliably recovered. In addition, since the winding roller and feeding roller are provided so as to contact or pressure-contact each other, only either one of the rollers is rotated and by controlling a rotary operation thereof, the other roller can be also driven to rotate and the controlled rotary operation can be transmitted to the other roller. Consequently, only one roller needs to be provided with the driving portion and the control system for controlling a rotary operation thereof so that the driving system and the control system can be simplified. Moreover, the roller driven to rotate can give a braking action on the roller mainly rotating and therefore, it is possible to omit a braking device. As a result, a configuration of the apparatus can be simplified and moreover, the space-saving for the apparatus can be realized.

Furthermore, since the winding roller and the feeding roller are provided so as to contact or pressure-contact each other, the developer attached to the cleaning member which is taken up after cleaning away the developer from a surface of the fixing roller is pressed by the winding roller and the feeding roller to be a thin film, and the thin film is equalized. Accordingly, an increase amount of a take-up diameter of the winding roller which is determined by the take-up amount of the cleaning member, a thickness of the cleaning member, and a thickness of the thin-filmed developer attached to the cleaning member, is equalized in a circumferential direction of the winding roller. In addition, it becomes possible to predict the increase amount with high accuracy. Accordingly, a control for rotary operations of the winding roller and feeding roller can be made easier. Further, in the invention, it is preferable that the control portion controls a length of rotational time of the feeding roller or winding roller so as to set either the feed amount of the cleaning member which is fed by the feeding roller at one feeding occasion, or the take-up amount of the cleaning member which is taken up by the winding roller at one take-up occasion.

According to the invention, the control portion controls a length of rotational time so as to set either the feed amount of the cleaning member which is fed by the feeding roller at one feeding occasion, or the take-up amount of the cleaning member which is taken up by the winding roller at one take-up occasion. By controlling the length of rotational time of the roller as described above when a rotational speed of the roller is set to a constant value, it is possible to set the feed amount and take-up amount of the cleaning member with high accuracy.

Further, in the invention, it is preferable that a driving portion for rotating a roller is provided on the winding roller among the feeding roller and winding roller which are provided so as to contact or pressure-contact each other via the cleaning member.

According to the invention, a driving portion for rotating a roller is provided on the winding roller, and the feeding roller is provided so as to contact or pressure-contact the winding roller, so that the feeding roller can be driven to rotate so as to follow rotation of the winding roller. By thus providing the driving portion on the winding roller which takes up the cleaning member having the cleaned-away developer attached thereto, and controlling a rotary operation of the winding roller, the driving system of the roller can be simplified. In addition, a necessary amount of the cleaning member for cleaning can be more reliably supplied to the nip section between the fixing roller and the pressure-contact roller.

Further, in the invention, it is preferable that each rotational axis line of the pressure-contact roller, feeding roller, and winding roller is disposed so as to be parallel to a rotational axis line of the fixing roller, and so as to intersect with one straight line which is perpendicular to the rotational axis line of the fixing roller.

According to the invention, each rotational axis line of the pressure-contact roller, feeding roller, and winding roller is disposed so as to be parallel to a rotational axis line of the fixing roller, and so as to intersect with one straight line which is perpendicular to the rotational axis line of the fixing roller. By so doing, it is possible to realize space-saving of the device.

Further, the invention provides an image forming apparatus for forming a print image in electrophotographic system, comprising the fixing device.

According to the invention, the fixing device is provided and therefore, the image forming apparatus is achieved which can form images for a long period of time without image failures attributable to offset.

BRIEF DESCRIPTION OF THE DRAWINGS

Other and further objects, features, and advantages of the invention will be more explicit from the following detailed description taken with reference to the drawings wherein:

FIG. 5 is a view illustrating a table data stored in a memory;

FIG. 7 is a view illustrating a table data for converting a size of a recording paper and a print ratio to a standard index value;

FIG. 8 is a view illustrating a table data for converting a size of a recording paper and a print ratio to a standard index value;

DETAILED DESCRIPTION OF THE PREFERRED EMBODIMENTS

Figure 1:
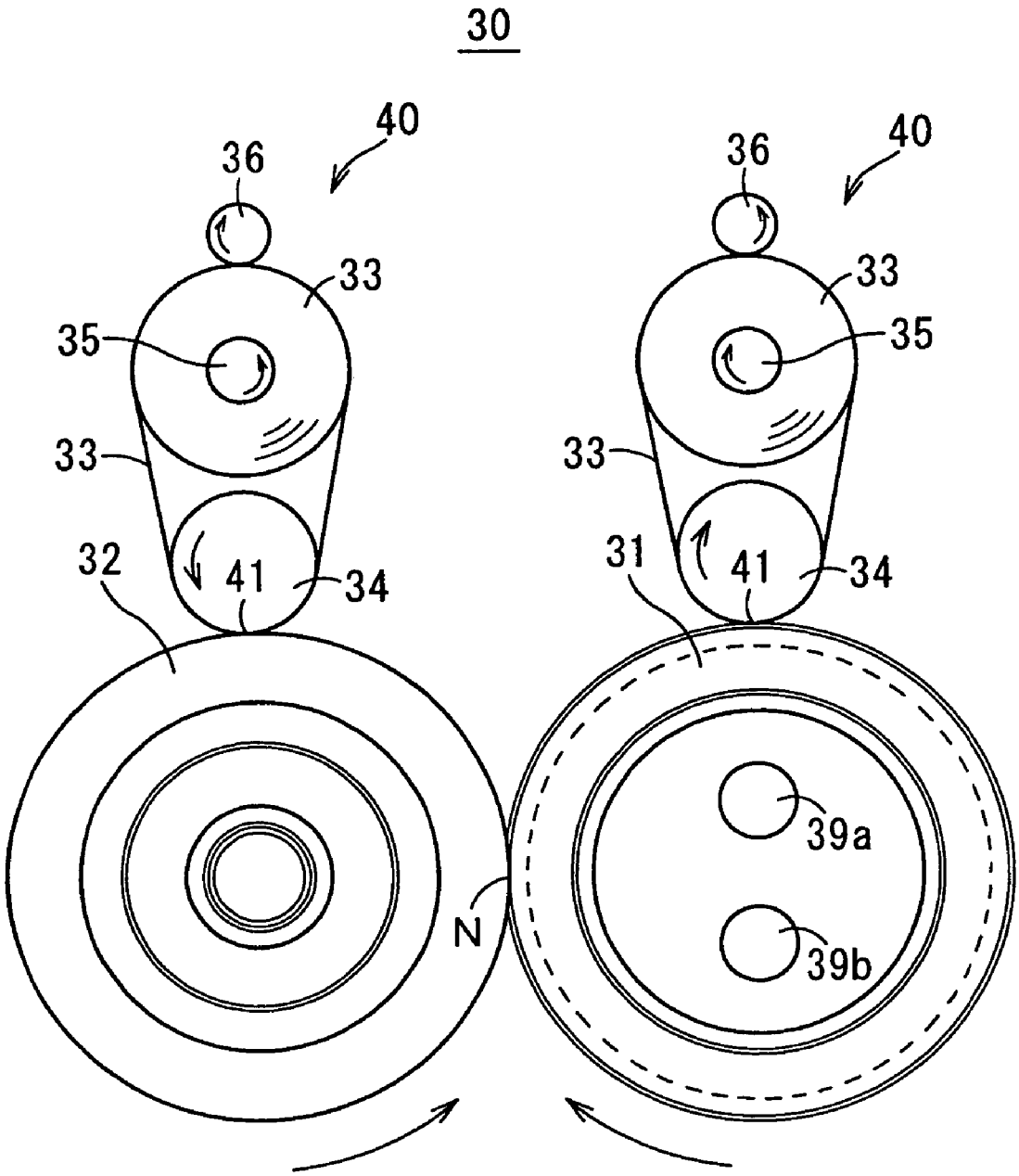
FIG. 1 is a schematic view showing a configuration of a fixing device according to one embodiment of the invention.

Now referring to the drawings, preferred embodiments of the invention are described below.

Figure 2B:
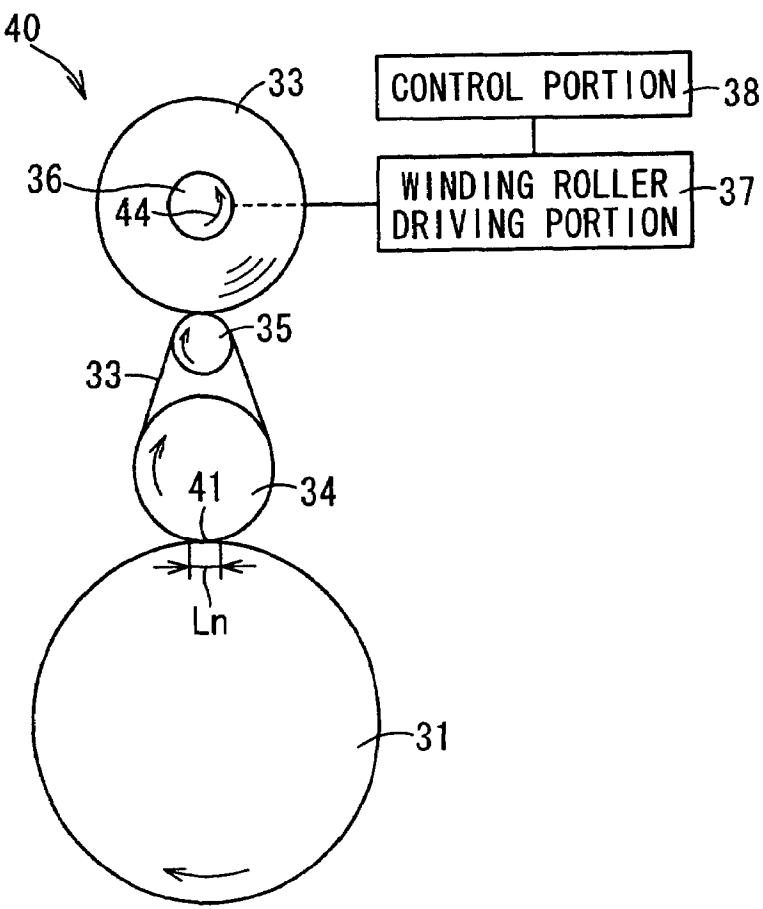
FIGS. 2A and 2B are enlarged views each showing a fixing roller cleaning unit provided around a heating roller in the fixing device shown in FIG. 1.
Figure 2A:
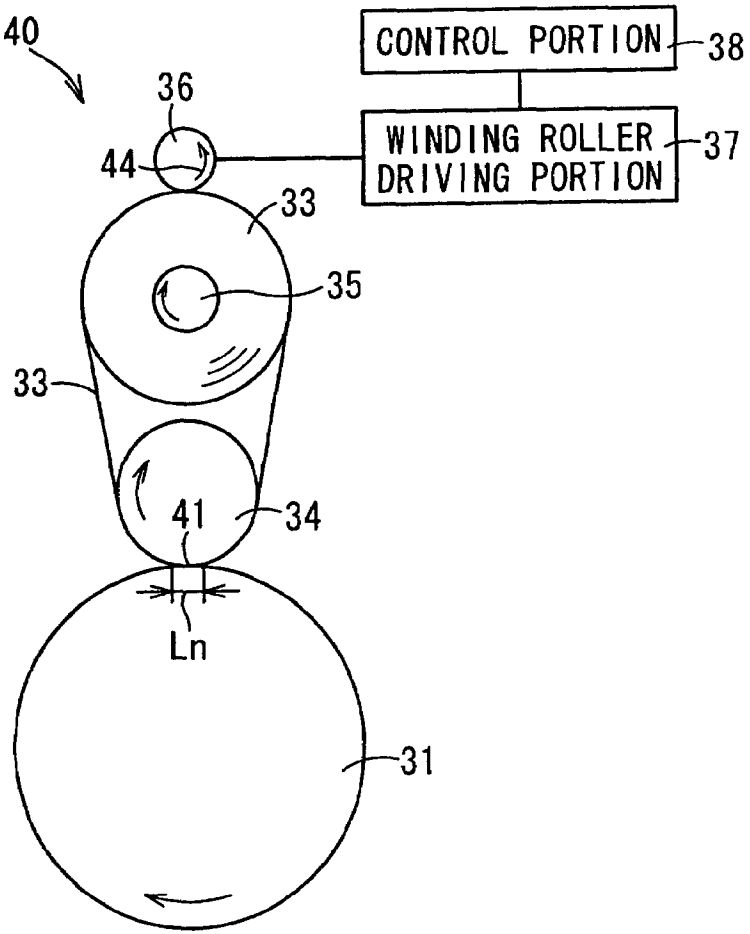

FIG. 1 is a schematic view showing a configuration of a fixing device 30 according to one embodiment of the invention. FIGS. 2A and 2B are enlarged views each showing a fixing roller cleaning unit 40 provided around a heating roller 31 in the fixing device 30 shown in FIG. 1.

The fixing device 30 comprises a heating roller 31; a pressure roller 32; a belt-shaped cleaning member 33; a pressure-contact roller 34; a feeding roller 35; a winding roller 36; a winding roller driving portion 37; and a control unit 38. The heating roller 31 and the pressure roller 32 are formed of a pair of rotators, and constitute fixing rollers. The belt-shaped cleaning member 33 is provided so as to contact the heating roller 31 and the pressure roller 32, respectively, and cleans surfaces of the fixing rollers. The pressure-contact roller 34 is provided so that a nip section 41 serving as a press portion is formed by pressing the cleaning member 33 onto the fixing roller in contact with the cleaning member 33. The feeding roller 35 feeds the belt-shaped cleaning member 33 which has been previously rolled up in a coil shape or a roll shape. The winding roller 36 takes up the cleaning member 33 which has been fed from the feeding roller 35 and cleaned the roller surface. Moreover, the winding roller 36 is provided so as to have a surface layer thereof in pressure-contact with a surface layer of the feeding roller 35 via the cleaning member 33. The winding roller driving portion 37 rotates the winding roller 36. The control portion 38 controls a rotary operation of the winding roller 36, to be more exact, an operation of the winding roller driving portion 37 so that a sum of a feed amount of the cleaning member 33 which is fed by the feeding roller 35 at one feeding occasion, and a take-up amount of the cleaning member 33 which is taken up by the winding roller 36 at one take-up occasion, is equal to or more than a double of a length of the nip section 41 in a feeding direction of the cleaning member 33. Note that, with respect to the heating roller 31, each rotational axis line of the pressure-contact roller 34, feeding roller 35, and winding roller 36 is disposed so as to be parallel to a rotational axis line of the heating roller 31, and so as to intersect with a straight line which is perpendicular to the rotational axis line of the heating roller 31. Similarly, with respect to the pressure roller 32, each rotational axis line of the pressure-contact roller 34, feeding roller 35, and winding roller 36 is disposed so as to be parallel to a rotational axis line of the pressure roller 32, and so as to intersect with a straight line which is perpendicular to the rotational axis line of the pressure roller 32.

Figure 12:
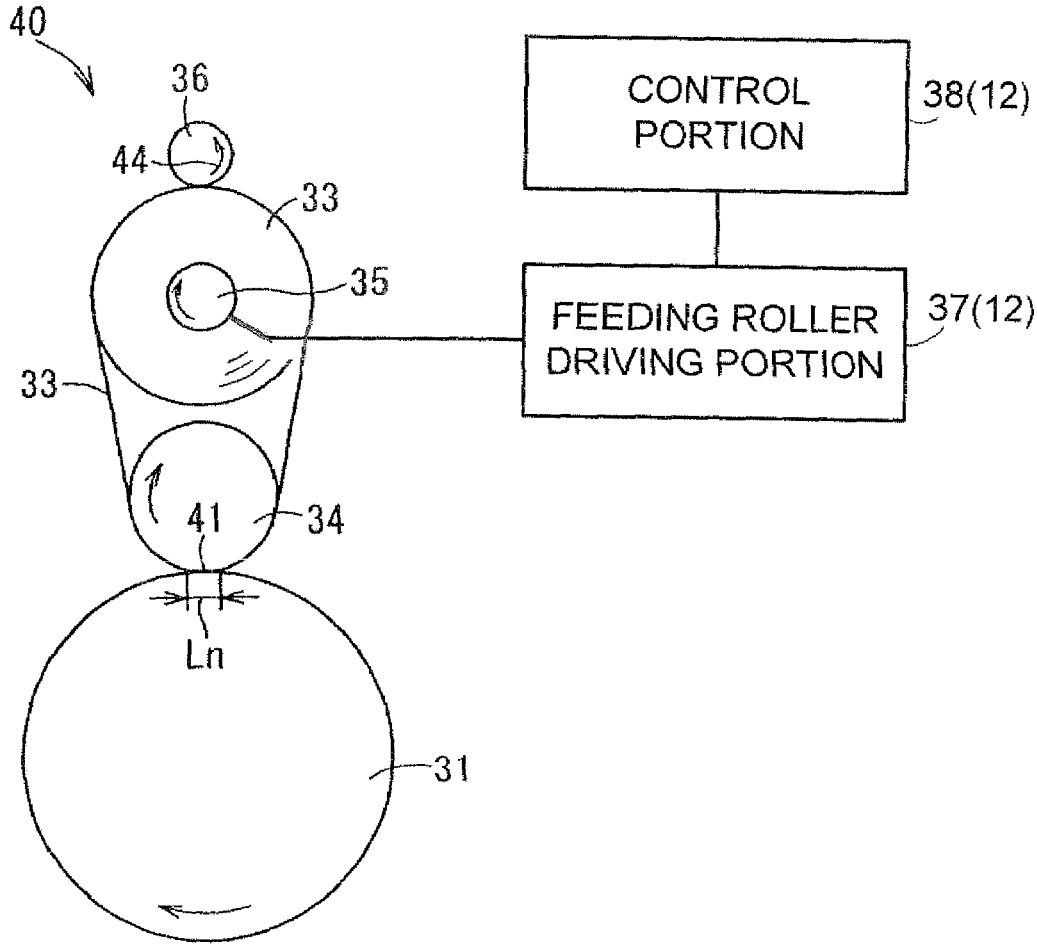
FIG. 12 is a schematic view showing an example embodiment of a fixing roller cleaning unit for the fixing device shown in FIG. 1, but wherein a feeding roller rather than a winding roller is controlled by a control portion.

In contrast to FIG. 2A, FIG. 12 shows a fixing roller cleaning unit for the fixing device shown in FIG. 1, but wherein feeding roller 35 rather than winding roller 36 is controlled by a control portion. In particular, FIG. 12 shows that feeding roller driving portion 37(12) is operated by control portion 38(12).

The fixing device 30 is provided with various portions which are similar to those provided in a heretofore known fixing device. These portions include, although not shown in FIGS. 1, 2A and 2B, a heater control power source for supplying electric power to heating heaters 39*a* and 39*b* serving as heat sources provided in the heating roller 31; a temperature sensor for detecting a temperature of the heating roller 31; a press portion for pressing the pressure roller 32 on the heating roller 31; and a driving portion for rotating the heating roller 31 and the pressure roller 32.

The fixing device 30 is mounted, for instance, in an electrophotographic image forming apparatus. In this case, the fixing device 30 is used for fixing that the unfixed developer is fused and fixed onto the recording medium by passing the recording medium on which an image of an unfixed developer is formed, through another nip section N formed by the heating roller 31 and the pressure roller 32.

Among all portions constituting the aforementioned fixing device 30, the cleaning member 33, the feeding roller 35, the pressure-contact roller 34, the winding roller 36, and the winding roller driving portion 37 constitute a fixing roller cleaning unit 40 for cleaning away a developer attached to a surface of the fixing roller. In the fixing device 30 according to the embodiment, the fixing roller cleaning units 40 are provided on both of the heating roller 31-side and the pressure roller 32-side. Since the heating roller 31 and the pressure roller 32 have the same configuration, the fixing roller cleaning unit 40 provided on the heating roller 31-side will be described as a representative example of the configuration so as to omit a description of the fixing roller cleaning unit 40 on the pressure roller 32-side.

The cleaning member 33 is a long belt-shaped windable and unwindable member. The cleaning member 33 has such a configuration that a developer attached in a fused state to a surface of the heating roller 31 can be entered into an air layer and/or an air gap which are minute spaces, that is, the developer 31*a* can be impregnated (absorbed) into the cleaning member 33. A material having heat resistance in a temperature of approximately 200° C. which is a fixing temperature, is used for the cleaning member 33, and for instance, Nomex paper (trade name) is preferable.

The pressure-contact roller 34 has at least an outermost layer formed of an elastic material having heat resistance so as to be transformed to some extent when pressed on the heating roller 31 and so as to form the nip section 41 between the heating roller 31 and the pressure-contact roller 34. The pressure-contact roller 34 is provided so that an axial line thereof is made to be parallel to an axial line of the heating roller 31, and the cleaning member 33 interposed between the heating roller 31 and the pressure-contact roller 34 is pressed on the surface of the heating roller 31 by the press portion (not shown).

The feeding roller 35 is a member in a reel form. The feeding roller 35 is mounted so as to be rotatable. Around the feeding roller 35 is rolled up the cleaning member 33 having a predetermined length. The feeding roller 35 is provided so as to pressure-contact the winding roller 36, to be more exact, via the cleaning member 33 rolled up on the feeding roller 35. Such a configuration is realized by providing a roller bearing for supporting the feeding roller 35 so as to be displaceable in a closely separating direction to a roller bearing for supporting the winding roller 36, and coupling the roller bearing for supporting the winding roller 36 and the roller bearing for supporting the feeding roller 35 by use of a biasing means such as a spring member, for instance. A press force for pressure-contacting the feeding roller 35 and the winding roller 36 each other is set to such a value that the winding roller 36 can be rotated, and a rotation force of the winding roller 36 is transmitted to the feeding roller 35 by a frictional force which is generated by pressure-contact between the feeding roller 35 and the winding roller 36, so that the feeding roller 35 is driven to rotate.

The winding roller 36 is a member in a reel form of the same sort of the feeding roller 35, and takes up the cleaning member 33 which has been fed from the feeding roller 35 and pressed against the heating roller 31 by the pressure-contact roller 34, and then cleaned the developer. The winding roller 36 is connected to the winding roller driving portion 37 and, due to the winding roller driving portion 37, configured so as to be rotatable. The winding roller driving portion 37 is configured so as to have an electric motor such as a stepping motor, whose rotational amount can be controlled with high accuracy. In the embodiment, a rotational speed is constant, and the rotational time control is carried out by an operational command from a control portion 38 so that the rotational amount (rotational angle) of the winding roller 36 is set.

Figure 3:
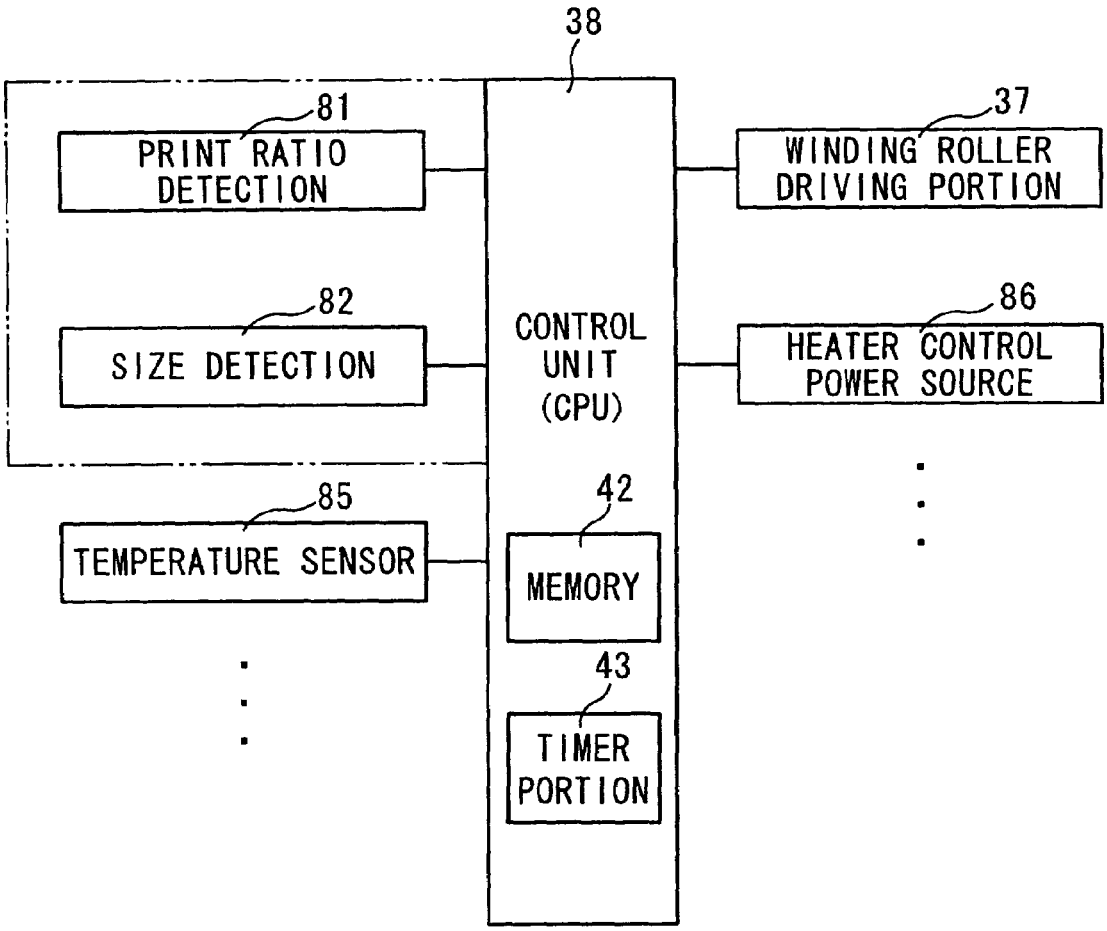
FIG. 3 is a block diagram showing an electrical structure in a case where the fixing device is mounted in an image forming apparatus, and a control portion provided in the image forming apparatus is used also as a control portion of the fixing device.

The control portion 38 is a process circuit having a central processing unit (CPU), for instance. The control portion 38 may be configured so as to be provided as an exclusive process circuit for the fixing device 30, and may also be used as a control portion of an after-mentioned image forming apparatus 50 in which the fixing device 30 is mounted. FIG. 3 is a block diagram showing an electrical structure in a case where the fixing device 30 is mounted in the image forming apparatus 50, and the control portion 38 provided in the image forming apparatus 50 is used also as a control portion of the fixing device 30. The control portion 38 is provided with a memory 42 and a timer portion 43. In the memory 42 is previously stored a program for controlling an entire operation of the image forming apparatus 30, and also stored is an after-mentioned table data for controlling the rotary operation of the winding roller 36. In addition, the timer portion 43 measures a time for the rotational time control over the winding roller driving portion 37 connected to the control portion 38, and outputs the result.

An operation of the fixing roller cleaning unit 40 will be simply described hereinafter. The cleaning member 33 is fed from the feeding roller 35 and made to pass through the nip section 41 formed between the pressure-contact roller 34 and the heating roller 31. And then, the cleaning member 33 is taken up by engaging a leading end thereof with the winding roller 36. When a setting of this cleaning member 33 is carried out, the winding roller 36 and the feeding roller 35 which is, to be more exact, the cleaning member 33 rolled up on the feeding roller 35, can be away from each other. After completion of the setting of the cleaning member 33, the winding roller 36 and the feeding roller 35 are made to pressure-contact each other via the cleaning member 33 by the aforementioned set press force.

The setting of the cleaning member 33 is completed as described above, and the take-up operation of the winding roller 36 is made to stop. In a state where the cleaning member 33 rests still, the heating roller 31 carries out rotary operation with the result that the surface of the heating roller 31 and the cleaning member 33 are slidingly scrubbed with each other so that the cleaning member 33 cleans the surface of the heating roller 31. When the developer has been cleaned away to some extent, a new portion of the cleaning member 33 is made to be fed out from the feeding roller 35 by rotating the winding roller 36 in an arrow sign 44 direction so that the new portion of the cleaning member 33 is supplied to the nip section 41. In other words, the winding roller 36 is intermittently rotated. The feeding roller 35 which pressure-contacts the winding roller 36 via the cleaning member 33, receives the rotation force of the winding roller 36 so that the feeding roller 35 is driven to rotate in synchronization with the operation of the winding roller 36. In this intermittent rotary operation, the control portion 38 controls the rotary operation of the winding roller 36 so that a sum of a take-up amount of the cleaning member 33 which is taken up by the winding roller 36 at one take-up occasion, and a feed amount of the cleaning member 33 which is fed by the feeding roller 35 at one feeding occasion, is equal to or more than a double of a length Ln of the nip section 41 in a circumferential direction of the pressure-contact roller 34. Here, the feed amount and take-up amount of the cleaning member 33 indicate lengths of the cleaning member 33 in a fed direction and in a taken-up direction.

In the fixing device 30 of the invention, the sum of the feed amount and the take-up amount at one feeding/take-up occasion, is equal to or more than a double of the length Ln of the nip section 41, and the feed amount and the take-up amount are controlled so as to be basically equal. Consequently, the feed amount and the take-up amount are respectively equal to or more than the length Ln and therefore, it is possible to reliably-feed an unused portion of the cleaning member 33 to the nip section 41 at every take-up occasion. Consequently, a cleaning performance by the cleaning member 33 can be reliably recovered.

Figure 4A:
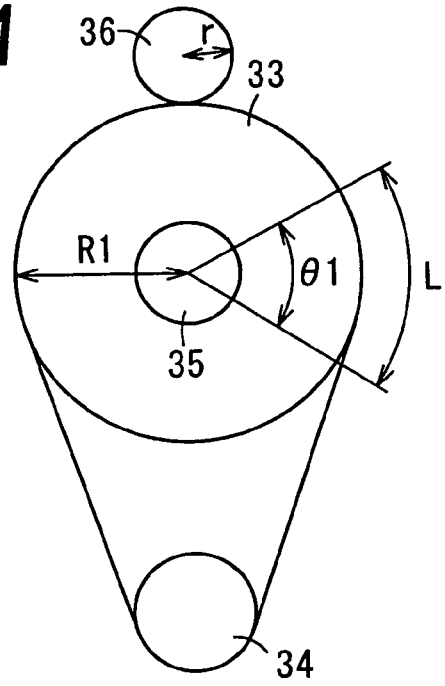
FIGS. 4A and 4B are views each showing a general outline of a rotational time control over a winding roller due to the control portion.
Figure 4B:
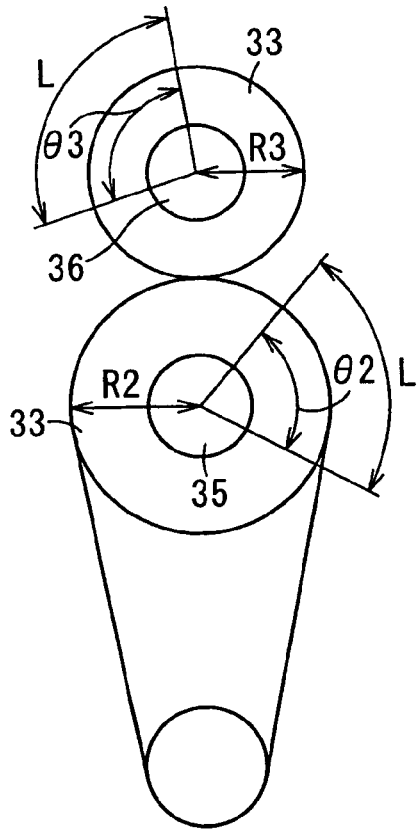

The control for making the sum of the take-up amount due to the winding roller 36 and the feed amount due to the feeding roller 35 be equal to or more than a double of the length Ln of the nip section 41 is achieved by controlling the length of rotational time of the winding roller 36. FIGS. 4A and 4B are views each showing a general outline of a rotational time control over the winding roller 36 due to the control portion 38. Hereinafter will be described the rotational time control over the winding roller 36 due to the control portion 38 with reference to FIGS. 4A and 4B.

A radius r of the winding roller 36 and the feeding roller 35 which are provided in the fixing device 30 is assumed to be constant at any time. A radius of the feeding roller 35 in an initial state, that is to say, a radius of the feeding roller 35 on which the cleaning member 33 in an unused state has been rolled up, is indicated by R1. The same cleaning member 33 is used at any time, and a thickness of the cleaning member 33 is indicated by t. On such a setting, the take-up amount and the feed amount at one occasion are respectively indicated by L (≧Ln). In this case, in the initial state such as a case where the feeding roller 35 shown in FIG. 4A, having the cleaning member 33 rolled up thereon has been replaced, for instance, a rotational angle θ (not shown) of the winding roller 36, which is necessary for taking up a take-up amount L at a first (n=1) take-up (feeding) occasion, is given by a formula [$\theta=360°\times L/(2\pi r)$]. On the other hand, the feeding roller 35 is provided so as to pressure-contact the winding roller 36, and driven to rotate so as to follow the rotation of the winding roller 36. Accordingly, the feeding roller 35 rotates by the same distance as the distance (feed amount L) in a circumferential direction, in which distance the winding roller 36 rotates. A rotational angle θ1 necessary for this rotation of the feeding roller 35, is given by a formula [$\theta1=360°\times L/(2\pi R1)$].

It is possible to set as functions of the number n of take-up (feeding) executions, a rotational angle θ3 of the winding roller 36 at a given n time occasion as shown in FIG. 4B, and a rotational angle θ2 of the feeding roller 35 driven to rotate by following the rotation of the winding roller 36. On the condition that the rotational angle θ1 of the feeding roller 35 in the initial state when the winding roller 36 has been operated for taking the take-up amount L, satisfies θ1=60°, the take-up (feeding) operations are executed for n=6 times and thereby, the feeding roller 35 goes into a 360-degree roll so that only one roll amount of the cleaning member 33 is fed. Accordingly, the radius of the winding roller 36 increases to [$r+t\cdot 2\pi R1/(2\pi r)$], and the radius of the feeding roller 35 decreases to be (R1−t). Likewise, a radius R3 of the winding roller 36 at a given n time occasion can be obtained as a function F (n) of the number n of the take-up (feeding) executions. In addition, a radius R2 of the feeding roller 35 can be also obtained as a function f(n) of the number n of the take-up (feeding) executions.

The radius R3 of the winding roller 36 is thus obtained. By so doing, the take-up amount L necessary for taking-up the take-up amount L is given by [$360°\times L/(2\pi R3)$]. Since the radius R3 is thus given as a function of the number n of the take-up execution, the rotational angle θ3 is also obtained as a function of the execution number n. Further, the radius R2 and the rotational angle θ2 of the feeding roller 35 driven to rotate by following the rotation of the winding roller 36 is given as a function of the number n of the take-up (feeding) executions. The rotational angle θ2 is given by [$360°\times L/(2\pi R2)$].

In the fixing device 30, the rotational speed of the electric motor which constitutes the winding roller driving portion 37, is made to be constant, and the control is carried out by the control portion 38 with respect to the length of rotational time in accordance with a timing due to the timer portion 43, so that the winding roller 36 has a desired rotational angle θ3. The above-described table data stored in the memory 42 relates to the number n of the executions, the rotational angle, and a length of rotational time required for rotating the winding roller 36 by only the angle, with respect to the winding roller 36.

FIG. 5 is a view illustrating the table data stored in the memory 42. In FIG. 5 is illustrated a table data concerning a case of having a standard diameter r=6 mm of the feeding roller 35 and the winding roller 36, a rolled-up diameter R1=20 mm of the feeding roller 35 in the initial state, the nip width Ln=10 mm, and the feed amount and take-up amount=10.5 mm. Note that in FIG. 5 is illustrated the rotational angle of the feeding roller 35 driven to rotate by following the rotary operation of the winding roller 36, as well as the rotational angle and rotational time, that is rotation driving time, of the winding roller 36, which are control objects of the rotary operation.

At a first time of the execution, the winding roller 36 is rotated for 3.33 seconds of rotational time, and the rotational angle corresponding to this rotational time is 200°. At this time, the rotational angle of the feeding roller 35 driven to rotate in pressure-contact with the winding roller 36 is 60°. In the same manner, at $n_m$ time of the execution when the rolled-up diameters of the winding roller 36 and the feeding roller 35 are made to be substantially equal, the winding roller 36 is rotated for 1.55 seconds of rotational time, and the rotational angle corresponding to this rotational time is 93°. The feeding roller 35 is also rotated by 93° of rotational angle as in the case of the winding roller 36. At $n_e$ time of the execution in a state where the feeding roller 35 has fed almost all the cleaning member 33, the length of rotational time is 1.0 second, and the rotational angle corresponding to this rotational time is 60°. At this time, the rotational angle of the feeding roller 35 is 200°.

The length of rotational time shown in FIG. 5 is just an illustration. It is needles to say that the length of rotational time changes depending on the rotational speed which is set on the electric motor used as the winding roller driving portion 37. In addition, the rotational angle of the winding roller 36 can be also controlled by making the length of rotational time of the winding roller driving portion 37 constant, and changing the rotational speed thereof. However, the rotational time control is preferably carried out as in the case of the fixing device 30 of the embodiment, because the control over the rotational speed is generally carried out by changing a current value which flows through the electric motor, but this control has lower control accuracy compared to the case where the rotational time control is carried out by making the rotational speed constant.

Illustrated above is the control over the length of rotation driving time in a case where the fed cleaning member 33 has the same thickness as the cleaning member 33 which has cleaned the fixing roller and then taken up. In a real operation of the fixing device 30, the developer may be attached to the cleaning member 33 which has cleaned the fixing roller and then taken up, so that an apparent thickness of the cleaning member 33 may increase.

When the apparent thickness of the cleaning member 33 increases, the taken-up radius of the winding roller 36 becomes larger by more than the increased amount of only the thickness of the cleaning member 33, compared to the taken-up radius in a case where the cleaning member 33 continues to be taken up in a state where a thickness t of the cleaning member 33 does not change. Consequently, when the winding roller 36 is made to rotate by the rotational angle obtained in accordance with the table data as shown in FIG. 5, for instance, the cleaning member 33 of more than the set take-up amount L will be additionally taken up because the actual take-up radius exceeds a value obtained as a function of the execution number n.

Such a problem can be solved by conducting the test in advance so that a take-up radius increase amount due to the developer attached to the cleaning member 33 is obtained as a predicted value, and by compensating the rotational angle and length of rotational time of the winding roller 36 on the basis of the predicted value. However, an attached amount of the developer attached to the cleaning member 33 by cleaning the fixing roller is uneven and therefore, error is generated from the predicted value, and a phenomenon may occur that the take-up amount of the cleaning member 33 due to the winding roller 36 does not become even.

According to the fixing apparatus 30 of the invention, the winding roller 36 and the feeding roller 35 are provided so as to pressure-contact each other, and the cleaning member 33 which has cleaned the surface of the fixing roller, passes through the pressure-contact portion between the winding roller 36 and the feeding roller 35, and is taken up by the winding roller 36. Accordingly, the developer attached to the cleaning member 33 is pressed by the pressure-contact portion so as to be a thin film having an equalized thickness.

Due to the foregoing, the predicted value of the take-up radius increase amount that is obtained by adding the thickness of the developer attached to the cleaning member 33 to the take-up radius of the winding roller 36 obtained as the function of the execution number n, can be conformed to the actual take-up radius increase amount with high accuracy. Consequently, it becomes simple to compensate the length of rotational time in controlling the rotary operation of the winding roller 36. This makes it possible to constantly stabilize the take-up amount L of the cleaning member 33 due to the winding roller 36.

In response to increase of the take-up radius of the winding roller 36 in addition to the thickness of the cleaning member 33 by a film thickness of the developer which is attached to the cleaning member 33 and formed into a thin film, the control for compensating the length of rotational time of the winding roller 36 can be realized as follows. On the basis of a type of the to-be-used developer, a predetermined fixing temperature, and the like, the increased amount of the apparent thickness of the cleaning member 33 due to the attachment of the developer is previously obtained by a test and then, for instance, a table data which is similar to the table data in FIG. 5 is previously drawn up.

In the fixing device 30 having the above-described configuration, the winding roller 36 and the feeding roller 35 are provided so as to pressure-contact each other. Accordingly, by making only the winding roller 36 rotate and controlling rotary operation thereof, the feeding roller 35 ca be driven to rotate, and the controlled rotary operation of the winding roller 36 can be transmitted to the feeding roller 35. Consequently, only the winding roller 36 needs to be provided with a driving portion and a control system for controlling rotary operation thereof, so that the driving system and the control system can be simplified. Moreover, the feeding roller 35 can give a braking action on the winding roller 36 which mainly rotates and therefore, it is possible to omit a braking device. In this manner, according to the fixing device 30, it is possible to omit the braking device and therefore, a configuration of the apparatus can be simplified and moreover, the space-saving for the apparatus can be realized.

Figure 6:
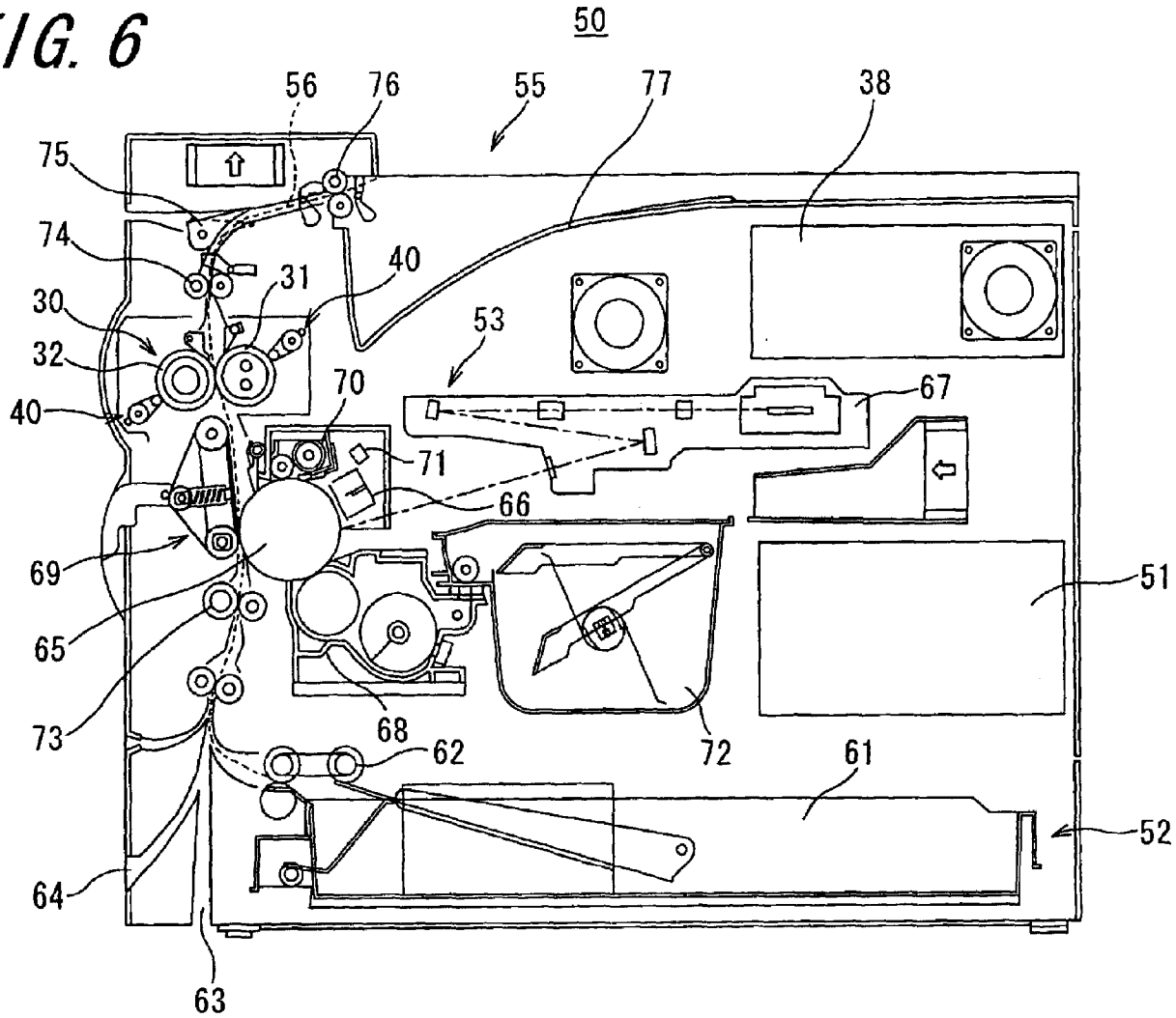
FIG. 6 is a schematic view showing a configuration of an image forming apparatus according to another embodiment of the invention.

FIG. 6 is a schematic view showing a configuration of an image forming apparatus 50 according to another embodiment of the invention. The image forming apparatus 50 is provided with the fixing device 30. The image forming apparatus 50 exemplified in the embodiment is an electrophotographic printer.

The image forming apparatus 50 largely comprises a power source portion 51 for supplying electric power to various portions of the image forming apparatus 50; a sheet supply portion 52 for supplying a recording paper serving as a recording medium on which an image is formed and recorded; an image forming unit 53; the fixing device 30; the control portion 38 for receiving image information from an external equipment and controlling an entire operation of the image forming apparatus 50; a discharge portion 55; and a sheet conveying system 56 for controlling conveyance of a recording paper from the sheet supply portion 52 to the discharge portion 55.

The sheet supply portion 52 is provided with a supply tray 61 for housing a recording paper, and a pickup roller 62 for feeding the recording paper housed in the supply tray 61 sheet by sheet to the sheet conveying system 56. Note that under the sheet supply portion 52 and under a main body of the image forming apparatus, a sheet supply unit including a multistage sheet tray, a high-capacity sheet supply unit capable of housing sheets in large quantity, or the like may be disposed as a peripheral equipment. In a case where such a peripheral equipment is provided, the recording paper from the peripheral equipment is supplied from a sheet receiving portion 63 and an expansive sheet receiving portion 64 to the main body of the image forming apparatus.

The image forming unit 53 is disposed above the sheet supply portion 52. The image forming unit 53 comprises a photoreceptor 65, and a charging unit 66, a light scanning unit 67, a developing unit 68, a transfer unit 69, a photoreceptor cleaning unit 70, and an electricity removing lamp 71, which are disposed along an outer circumferential surface of the photoreceptor 65.

The charging unit 66 uniformly charges a surface of the photoreceptor 65 which has not yet been exposed to light by the light scanning unit 67. The light scanning unit 67 scans the uniformly charged photoreceptor 65 with light in accordance with the image information so as to form an electrostatic latent image. The developing unit 68 supplies the developer inside a developer supply container 72 to the electrostatic latent image formed on the surface of the photoreceptor 65 so as to form a visualized developer image.

The transfer unit 69 transfers the developer image on the recording paper which is supplied in arranged timing so that a registration roller 73 provided upstream of the photoreceptor 65 in the sheet conveying system 56 registers the recording paper at a developer image forming position on the photoreceptor 65.

The photoreceptor cleaning unit 70 removes a residual developer which has not been transferred on the recording paper and remains on the photoreceptor 65. The electricity removing lamp 71 removes charges on the surface of the photoreceptor 65, thereby preparing for next uniform charging of the charging unit 66.

The fixing device 30 is provided downstream of the transfer unit 69 in the sheet conveying system 56 so that the developer image transferred on the recording paper is fixed so as to form a solid recording image.

A conveyance roller 74 and a switching gate 75 are disposed further downstream of the fixing device 30 in the sheet conveying system 56. The conveyance roller 74 conveys the recording paper which has passed through the fixing device 30, to further downstream in the sheet conveying system 56. The switching gate 75 optionally opens a conveyance path which is suitable for the recording paper to be conveyed by the conveyance roller 74. The discharge portion 55 comprises a discharge roller 76 provided further downstream of the switching gate 75 in the sheet conveying system 56, and a discharge tray 77 for placing the recording paper discharged outward the main body of the image forming apparatus by the discharge roller 76.

The control portion 38 serves also as a control portion of the image forming apparatus 50 and a control portion of the fixing device 30 as described above. With reference to FIG. 3, the control portion 38 has accessories such as a memory 42 serving as a storing portion, a timer portion 43 and in addition, an interface for receiving image information from an external equipment (not shown). The control portion 38 controls an entire operation of the image forming apparatus 50, which operation includes the operation of the fixing device 30. The memory 42 of the control portion 38 previously stores a program and an operational control condition for controlling the entire operation of the image forming apparatus 50.

An image forming operation in the image forming apparatus 50 will be described hereinafter. For instance, image information produced by external equipments such as a personal computer is given to the control portion 38 via the interface and then, the image information is stored in the memory 42 of the control portion 38. The control portion 38 reads out the image information from the memory 42 and performs image processing such as conversion process. And then, the control portion 38 feeds to the light scanning unit 67 the image information on which the image processing has been performed. The light scanning unit 67 irradiates the surface of the photoreceptor 65, which has been charged by the charging unit 66 so as to have a uniform electric potential, with light in accordance with the image information so as to form an electrostatic latent image.

The electrostatic latent image formed on the surface of the photoreceptor 65 is developed by the developing unit 68 so as to be a developer image. The transfer unit 69 transfers the developer image formed on the photoreceptor 65 onto the recording paper which has been supplied from the sheet supply portion 52 and fed in arranged timing by the registration roller 73. The recording paper, on which the developer image has been transferred, is fixed by the fixing device 30 and then discharged to the discharge tray 77 by the discharge roller 76.

On the other hand, the photoreceptor 65 from which the developer image is detached by the transfer unit 69, has the residual developer cleaned by the photoreceptor cleaning unit 70 and the electricity removed by the electricity removing lamp 71. The image forming apparatus 50 can repeat the aforementioned image forming operation.

The fixing device 30 mounted on the image forming apparatus 50 operates so that the developer on the recording paper is made to be fused and softened so as to be fixed on the recording paper. However, the developer is attached to the fixing roller by repeating a fixing operation on a plurality of the recording papers and therefore, the fixing roller is cleaned by the cleaning member 33 of the fixing roller cleaning unit 40 as described above. Furthermore, attributable to the cleaning, in a gap between the cleaning member 33 and the fixing roller is accumulated to some extent the developer removed from the fixing roller and then, the feeding roller 36 is made to rotate by the above-described time control. The cleaning member 33 is fed from the feeding roller 35 driven by rotation of the winding roller 36 by a feed amount corresponding to the take-up amount predetermined by the length of the rotational time of the winding roller 36, so that a clean portion of the cleaning member 33 is newly made to be slidingly scrubbed with the fixing roller. By so doing, the cleaning member 33 is made to recover a cleaning capability thereof so as to continue to clean the fixing roller for a long period of time. In this manner, the operation that the winding roller 36 is made to rotate by the time control is an intermittent rotary operation.

A timing that the winding roller 36 starts the intermittent rotary operation, namely a timing that the take-up operation is intermittently carried out, depends on an amount of the developer accumulating in the gap between the cleaning member 33 and the fixing roller. Since the amount of the accumulating developer is substantially proportional to an amount of the developer on the recording paper which passes through the fixing device 30 and is fixed, the amount of the accumulating developer can be obtained by a size of the recording paper and a print ratio with respect to the recording paper.

Consequently, in the image forming apparatus 50 in which the fixing device 30 is mounted, the timing of taking up the cleaning member 33 of the fixing device 30 is determined by the size of the recording paper and the print ratio with respect to the recording paper as indexes so that the winding roller 36 is made to rotate by the time control.

Returning to FIG. 3, the intermittent rotary operation of the fixing device 30 mounted in the image forming apparatus 50 will be described. FIG. 3 shows also an electrical structure according to the intermittent rotary operation of the fixing device 30. The image forming apparatus 50 provided with the fixing device 30, comprises a print ratio detecting portion 81 for detecting the print ratio of to-be-formed print image, and a size detecting portion 82 for detecting the size of the recording paper on which the print image is recorded. The control portion 38 responds to detected outputs of the print ratio detecting portion 81 and the size detecting portion 82, and controls the winding roller 36 provided in the fixing device 30, in connection with a timing of starting the rotary operation of the intermittent rotation, and the length of rotational time. Note that to the control portion 38 are connected various input systems and output systems other than various portions shown in FIG. 3, for operating the image forming apparatus 50, but these systems are omitted in order to avoid intricacy of the drawing.

In the image forming apparatus 50, since the image information is given to the control portion 38 as digital data from external equipments such as a personal computer, for instance, and the print ratio of the image is included in the image information, the control portion 38 which has received the image information can detect the print ratio of the image information. Accordingly, in the embodiment, the control portion 38 serves as well as the print ratio detecting portion 81.

In addition, when the image information together with the print command is given from the personal computer to the control portion 38, the information according to the print command includes the size of the recording paper on which an image should be formed. Consequently, the size of the recording paper can be detected likewise by the control portion 38. Moreover, when the image information once stored in the memory 42 of the control portion 38 is read out on the image forming apparatus 50-side so as to form an image, for instance when an operator inputs a print request from an operating portion of the image forming apparatus 50 so as to form an image, the to-be-inputted print request information includes the size of the recording paper and therefore, the control portion 38 for receiving the print request information can detect the size of the recording paper. Accordingly, in the embodiment, the control portion 38 serves as well as the size detecting portion 82.

On the basis of the print ratio of the image information and the size of the recording paper on which an image should be formed, being detected by the print ratio detecting portion 81 and the size detecting portion 82 as which the control portion 38 serves as well, the control portion 38 determines the timing of starting the rotary operation of the winding roller 36, and the length of time for rotationally driving the winding roller 36 based on the above-described table data shown in FIG. 5 and then, outputs a command for the rotary operation with respect to the winding roller driving portion 37 in accordance with a measured time outputted from the timer portion 43.

Note that the electrical structure according to the operation of the fixing device 30 in the image forming apparatus 50 includes a temperature sensor 85 provided on the fixing roller, and a heater control power source 86 for turning on/off an electric power supply with respect to the heating heaters 39*a* and 39*b* of the heating roller 31. A detected result of a temperature of the fixing roller due to the temperature sensor 85 is inputted to the control portion 38 so that the control portion 38 controls an operation of the heater control power source 86, thereby setting the temperature of the fixing roller to a desired temperature.

Hereinafter, there is illustrated one method of determining the timing of starting the rotary operation due to the control portion 38. In the image forming apparatus 50 of the embodiment, the timing of starting the rotary operation of the winding roller 36 is determined by the print ratio and the size of the recording paper to be printed at the print ratio as indexes.

As described above, the developer amount accumulating on the cleaning member 33 which is in contact with the fixing roller is substantially proportional to the developer amount on the recording paper which passes through the fixing device 30 and is fixed. Accordingly, in a case where the size of the recording paper is the same, the developer is accumulated faster with a higher print ratio. Moreover, in a case where the print ratio is the same, the developer is accumulated faster with a larger recording paper.

Consequently, the size of the recording paper and the print ratio with respect to the recording paper are multiplied by a coefficient for weighting, and converted to a case of being printed on the recording paper of a standard size at a standard print ratio, with the result that the obtained value can be recognized as an index in order to know an accumulated amount of the developer, in other words, a soiling degree of the cleaning member 33. This index value is accumulated, and when this integrated value becomes equal to a standard value or more, the standard value being predetermined as a cleaning limitation of the cleaning member 33, a clean portion of the cleaning member 33 can be newly made to contact the fixing roller by taking up the cleaning member 33 so that a cleaning capability can be recovered.

In the image forming apparatus 50, in the memory 42 provided in the control portion 38 is previously stored a table data for converting the size of the recording paper and the print ratio with respect to the recording paper to the case of being printed on the recording paper of the standard size at the standard print ratio. The control portion 38 responds to the size of the recording paper detected by the size detecting portion 82, and the print ratio detected by the print ratio detecting portion 81. The control portion 38 obtains a standard index value based on the aforementioned table data and then, obtains an integrated value by accumulating the standard index value and furthermore, compares the integrated value to a predetermined standard value. When the integrated value becomes equal to or more than the standard value, the control portion 38 outputs an operational command to the winding roller driving portion 37 and then, takes up the cleaning member 33 by driving the winding roller 36 to rotate so as to be controlled in connection with the length of time.

FIGS. 7 and 8 are views illustrating table data for converting the size of the recording paper and the print ratio to the standard index value. In the image forming apparatus 50 of the embodiment is standardized on a case where a paper of A4 size prescribed in Japanese Industrial Standards (JIS) P0138 is widthwise conveyed and fixed.

In FIG. 7 is shown a conversion ratio for converting the prints on papers of various sizes to a case of an A4 size widthwise conveyance serving as a standard index. In FIG. 8 is shown a conversion ratio for converting the value, which has been converted to the case of the A4 size widthwise conveyance, to a case of a print ratio of 5% or less which is selected as a standard, further in the A4 size widthwise conveyance. A calculation of the integrated value in the control portion 38 will be illustrated hereinbelow. For instance, when the recording paper passing through the fixing device 30 just has a print ratio of 8 to 12% in a size A3, this is converted to the standard index value which is a print ratio of 5% or less in the A4 size widthwise conveyance. First, a paper of A3 size is converted to two sheets of the recording papers of the print ratio of 8 to 12% in the A4 widthwise conveyance by accumulating the conversion rate 2.00 based on the table data in FIG. 7. Next, the print ratio of 8 to 12% in the A4 widthwise conveyance is converted to four sheets of the recording papers by accumulating the conversion rate 2.00 for converting to the print ratio of 5% or less in the A4 widthwise conveyance based on the table data in FIG. 8. Thus, when one sheet of the recording paper of the print ratio of 8 to 12% in the A3 is fixed, the recording paper is converted to the four sheets of the recording papers of the print ratio of 5% or less in the A4 widthwise conveyance serving as the standard index value.

Every time one sheet of the recording paper is fixed by the fixing device 30, the control portion 38 thus converts the number of the recording paper to the standard index value, and performs a calculation of accumulating the converted value so as to obtain the integrated value. When this integrated value becomes the standard value or more, the control portion 38 outputs the operational command to the winding roller driving portion 37 so that the winding roller 36 carries out the take-up operations of the cleaning member 33.

Figure 9:
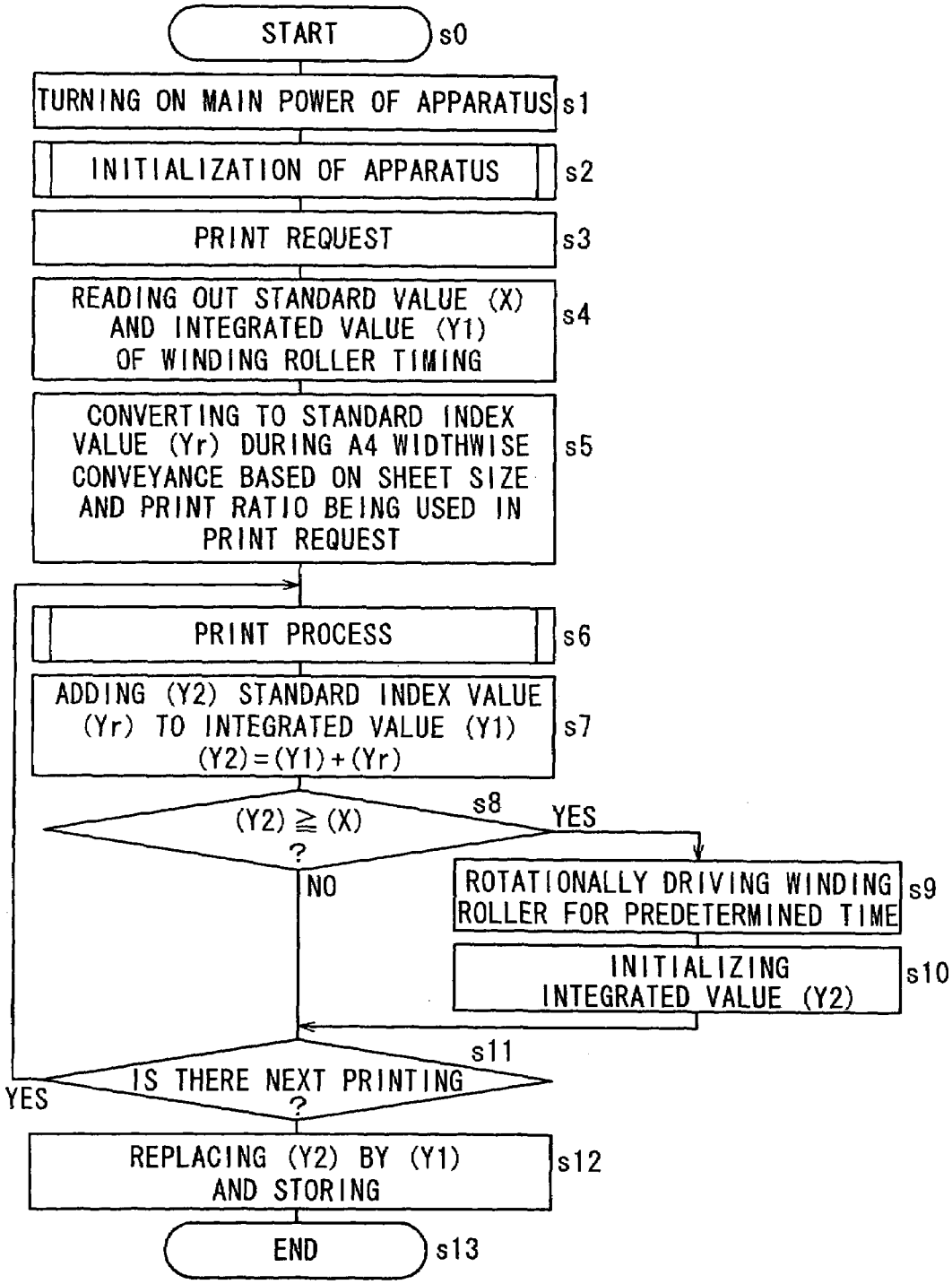
FIG. 9 is a flow chart for explaining a take-up operation of a cleaning member.
Figure 10:
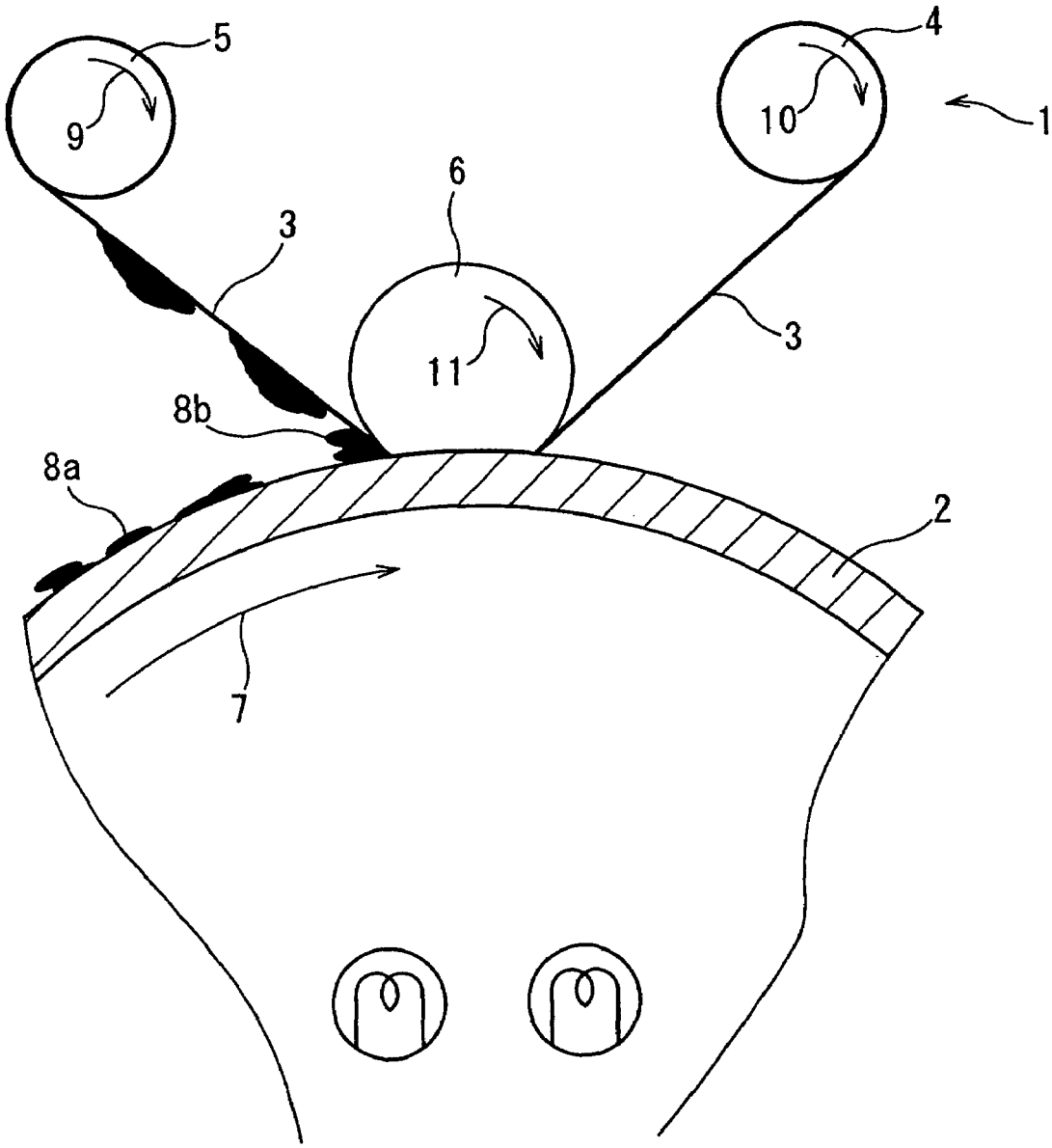
FIG. 10 PRIOR ART
FIG. 10 is a schematic view showing a configuration of a fixing roller cleaning unit provided in a related art fixing device.
Figure 11A:
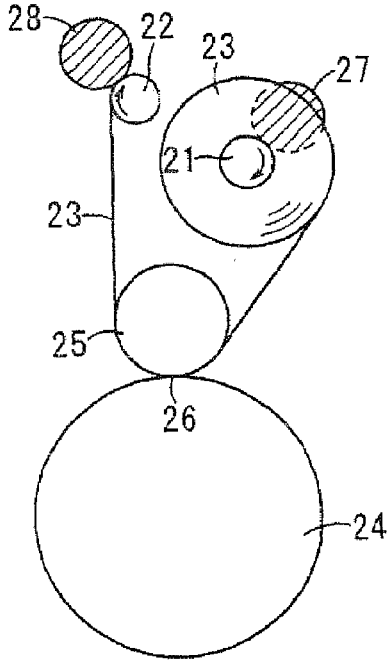
FIG. 11A PRIOR ART
FIGS. 11A and 11B are schematic views each showing a roller cleaning unit provided in a fixing device according to a related art.
Figure 11B:
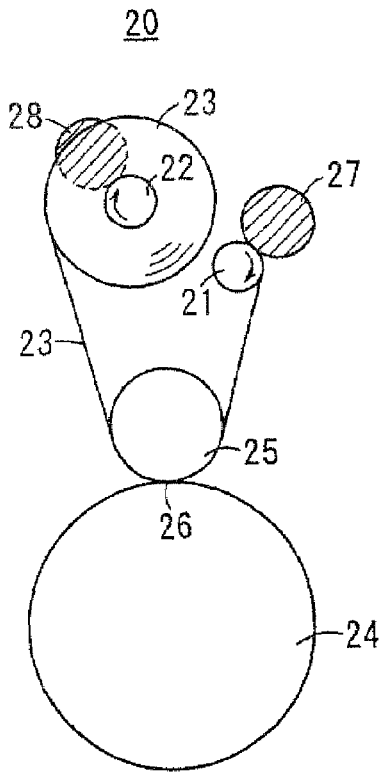
FIG. 11B PRIOR ART

FIG. 9 is a flow chart for explaining the take-up operations of the cleaning member 33. With reference to the FIG. 9, the feeding operations of the cleaning member 33 will be described.

A start of step s0 is a state where, for instance, image information previously created by a personal computer or the like is given to the image forming apparatus 50, and stored in the memory 42 of the control portion 38 in the image forming apparatus 50, and then the print request is inputted to the image forming apparatus 50 with the result that image read out from the memory 42 can be printed and fixed.

At step s1, a main power of the image forming apparatus 50 is turned on by the operator. At step s2, the control portion 38 initializes the image forming apparatus 50. Here, the initialization of the image forming apparatus 50 indicates a set of preliminary operation for the image forming apparatus 50 to perform image formation. The preliminary operation includes removal of residual potential of the photoreceptor 65, temperature rising of the fixing roller up to a prescribed temperature, and the like. At step s3, a print request is inputted by the operator from an input portion provided in the image forming apparatus 50. This print request includes a designation of the to-be-printed image information among the image information stored inside the memory 42, a designation of the size of the recording paper for recording the image information, and the number of printing sheets.

At step s4, the control portion 38 reads out from the memory 42 a standard value (X) which is predetermined as a cleaning limitation of the cleaning member 33 and previously stored in the memory 42, and an integrated value (Y1) obtained by accumulating the values which are obtained by converting to the standard index values during a previous print operation. At step s5, in response to the designation of the to-be-printed image information and the designation of the size of the recording paper for recording the image information, the control portion 38 serving as well as the print ratio detecting portion 81 and the size detecting portion 82, detects the print ratio from the designated image information, and detects the size of the recording paper. Further, the control portion 38 responds to the detected print ratio and recording paper size, so as to calculate the standard index value (Yr) which is converted to A4 widthwise conveyance and the print request 5% or less regarding the to-be-printed image information based on the table data shown in FIGS. 7 and 8.

At step s6, a print process is executed in the image forming unit 53 of the image forming apparatus 50, and a fixing process is executed in the fixing device 30. At step s7, the control portion 38 obtains the integrated value (Y2) by adding the standard index value (Yr) to the integrated value (Y1), that is (Y2)=(Y1)+(Yr).

At step s8, the control portion 38 compares the integrated value (Y2) and the standard value (X). When the integrated value (Y2) is equal to or more than the standard value (X), the operation proceeds to step s9. When the integrated value (Y2) is less than the standard value (X), the operation proceeds to step s11.

At step s9, the integrated value (Y2) is equal to or more than the standard value (X) predetermined as the cleaning limitation and therefore, the control portion 38 outputs the operational command to the winding roller driving portion 37 so that and the winding roller 36 is made to rotate by the time control in accordance with the above-described table data shown in FIG. 5, for instance. Here, the length of time that the take-up amount of the winding roller 36 is L (≧the nip section length Ln). Note that the feeding roller 35 driven to rotate by the rotary operation of the winding roller 36 feeds the cleaning member 33 by a length thereof, which length is the same as that of the above-mentioned take-up amount L. At step s10, since the cleaning member 33 has been taken up so as to be in a state of capable of cleaning with the clean portion, the control portion 38 initializes the integrated value (Y2) (in the embodiment, to zero sheet) which can be also called as an index for the soiling degree of the cleaning member 33.

At step s11 is determined whether there is next print process or not. This determination is conducted by the control portion 38. Since the previous print request includes the information of the number of the printing sheets, the control portion 38 can determine whether there is next printing or not by counting the number of times of the print process. When there is no next print process, the operation proceeds to step s12 and when there is a next print process, the operation returns to the step s6 and the subsequent steps are repeated. At step s12, the integrated value (Y2) is replaced by the integrated value (Y1) and stored in the memory 42, and then the operation proceeds to End of step s13.

At the End of step s13, the main power of the image forming apparatus 50 can be turned off so as to end the image forming operation. In this case, a next image forming operation resumes from the step s1. Moreover, at the End of step s13, it is also possible to bring a standby state that the print process is not operated, but neither is the main power turned off. In this case, the next image forming operation resumes from the print request at step s3.

As described above, the embodiment has a configuration that the winding roller is rotated so as to drive the feeding roller to rotate among the winding roller and the feeding roller. However, the configuration is not limited to the above-described configuration. It may be also possible to have a configuration that the feeding roller is rotated so as to drive the winding roller to rotate.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A fixing device comprising:

fixing rollers which form a pair of rotators, for fusing and fixing an unfixed developer onto a recording medium by passing the recording medium having an image of an unfixed developer formed thereon through a pressure contact section formed by the fixing rollers;

a belt-shaped cleaning member provided so as to contact at least either one of the fixing rollers, for cleaning a surface of the fixing roller;

a pressure-contact roller provided so that a nip section serving as a press portion is formed by pressing the cleaning member onto the fixing roller which is in contact with the cleaning member;

a feeding roller for feeding the belt-shaped cleaning member which has been rolled up;

a winding roller for taking up the cleaning member which has been fed from the feeding roller and cleaned the surface of the fixing roller, the winding roller being provided so as to have a surface layer thereof in contact or pressure-contact with a surface layer of the feeding roller via the cleaning member; and a control portion for controlling rotary operation of either the feeding roller or the winding roller so that a sum of a feed amount of the cleaning member which is fed by the feeding roller at one feeding occasion, and a take-up amount of the cleaning member which is taken up by the winding roller at one take-up occasion, is equal to or more than a double of a length of the nip section in a circumferential direction of the pressure-contact roller.

2. The fixing device of claim 1, wherein the control portion controls a length of rotational time of the feeding roller or winding roller so as to set either the feed amount of the cleaning member which is fed by the feeding roller at one feeding occasion, or the take-up amount of the cleaning member which is taken up by the winding roller at one take-up occasion.

3. The fixing device of claim 1, wherein a driving portion for rotating a roller is provided on the winding roller among the feeding roller and winding roller which are provided so as to contact or pressure-contact each other via the cleaning member.

4. The fixing device of claim 1, wherein each rotational axis line of the pressure-contact roller, feeding roller, and winding roller is disposed so as to be parallel to a rotational axis line of the fixing roller, and so as to intersect with one straight line which is perpendicular to the rotational axis line of the fixing roller.

5. An image forming apparatus for forming a print image in electrophotographic system, comprising the fixing device of claim 1.

* * * * *